US006452316B1

(12) United States Patent
Hartley et al.

(10) Patent No.: US 6,452,316 B1
(45) Date of Patent: Sep. 17, 2002

(54) SELF ALIGNING PEN LIGHT BULB

(75) Inventors: Fred Jack Hartley, Fort Myers, FL (US); Joseph Wong, Hong Kong (CN)

(73) Assignee: Bright Lite Company of Lee County, Ft. Myers, FL (US)

( * ) Notice: Subject to any disclaimer, the term of this patent is extended or adjusted under 35 U.S.C. 154(b) by 0 days.

(21) Appl. No.: 09/814,153

(22) Filed: Mar. 21, 2001

(51) Int. Cl.[7] ..... H01J 5/02

(52) U.S. Cl. ..... 313/317; 313/318.01; 313/110; 313/634; 362/118

(58) Field of Search ..... 313/315, 317, 313/318.01, 634, 573, 578, 569, 110, 116, 117, 493; 362/202, 118

(56) References Cited

U.S. PATENT DOCUMENTS 2,500,364 A * 3/1950 Kopp ..... 362/202
4,023,298 A * 5/1977 Story ..... 43/17
4,516,194 A * 5/1985 Johns ..... 362/202
6,056,415 A * 5/2000 Allred, III et al. ..... 362/202

FOREIGN PATENT DOCUMENTS

GB 2109527 * 6/1983 ..... F21L/7/00

* cited by examiner

*Primary Examiner*—Vip Patel
*Assistant Examiner*—Thelma Sheree Clove

(57) ABSTRACT

A pen light bulb which is self aligning in conventional pen light flashlights is disclosed. Applicable pen light flashlights rely upon pressure bearing retention of the bulb therein. A focusing lens protective element of the pen light bulb has various features which provide for a more stable seating surface thereon to contact the housing of the pen light flashlight. These features provide for the axis of projection of the beam of light from the bulb to match, or nearly match, a central axis of the pen light flashlight. A wider and larger spring contact surface on a circular base of the housing of the pen light bulb provides for a truer application of pressure by a spring to the pen light bulb to assist in proper alignment within conventional pen light flashlights.

11 Claims, 6 Drawing Sheets

20

FIG. 4
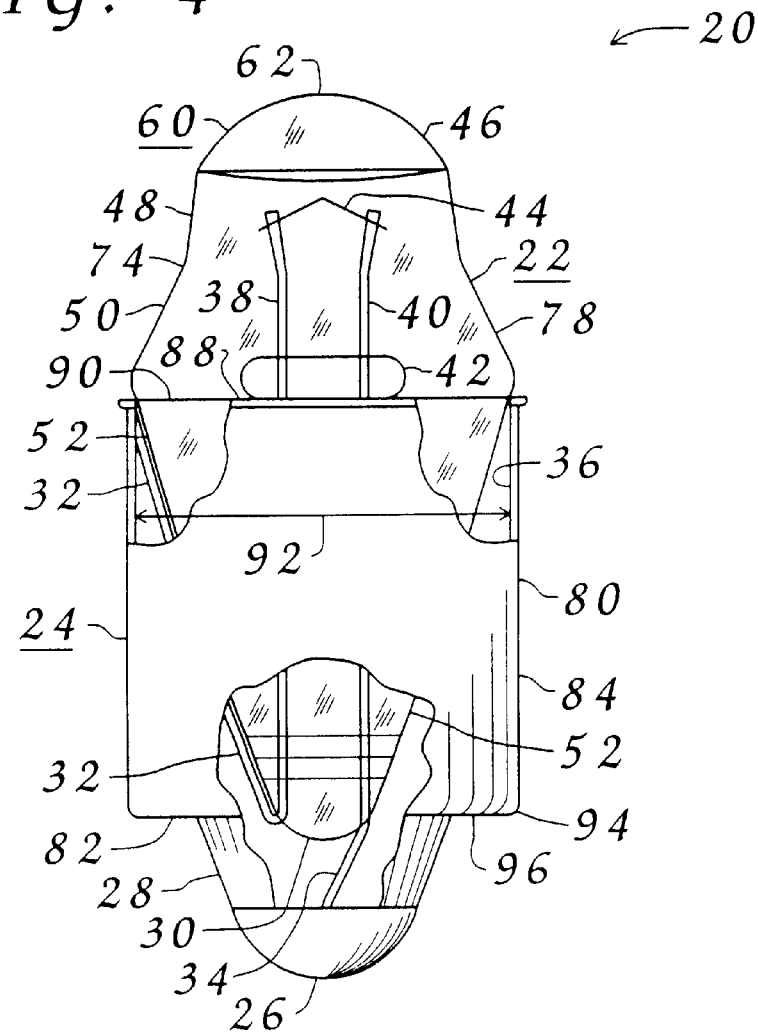
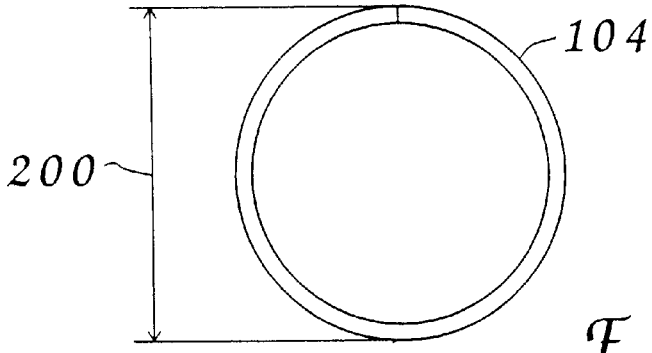
FIG. 5
PRIOR ART

SELF ALIGNING PEN LIGHT BULB

BACKGROUND

1. Field of the Invention

Generally, the invention relates to small light bulbs. More specifically, the invention relates to such light bulbs suitable for use in conventionally known pen light flashlights where a portion of the bulb proper acts to focus and direct a beam of light utilizing optical focusing qualities contained entirely on the bulb.

2. Description of the Prior Art

Pen light flashlights produce a beam of light wherein the bulb contains structures which focus the produced light into the desired beam. The discussion of the prior art will be limited to these types of flashlight, and applicable bulbs which are sometimes referred to as lamps.

There exist three mounting methods for pen light bulbs within conventionally known pen light flashlights. A first method of mounting the bulb within the pen light flashlight involves providing threads within the housing of the pen light flashlight which receive threads positioned on the bulb. This type of mounting generally provides for proper and true alignment of the bulb within the pen light flashlight wherein the axis of the beam of produced light aligns with a central axis of the pen light flashlight. One major disadvantage of this type of pen light flashlight involves an increase in production costs associated with fairly precise production of the threads within the housing of the pen light flashlight. A second method of mounting the bulb within the pen light flashlight involves utilization of the typical mounting method used in conventional collimating flashlights wherein a relatively wide rim on the bulb is held between two securement structures of the pen light flashlight. Typically these two securement structures will involve opposing threads which cooperate to trap the bulb between two radially disposed trapping surfaces. One major disadvantage of this type of pen light flashlight also involves an increase in production costs associated with fairly precise production of a set of threads within the housing of the pen light flashlight and fairly precise production of a ring member with a set of threads thereon. A third method of mounting the bulb within the pen light flashlight involves retention of the bulb utilizing a pressure bearing contact of the bulb against a portion of the housing of the pen light flashlight. Pen light flashlights which use this pressure bearing method of mounting have the advantage of being inexpensive to manufacture when compared to pen light flashlights which utilize either of the other methods of mounting of the bulb.

The pressure bearing contact method is the method applicable to the present invention and typically involves providing a radially disposed inwardly facing seating surface situated about a terminal end aperture upon which a transparent end of the bulb rests with a focusing portion of the bulb extending outward through the aperture. A spring member typically applies the pressure. This spring is either positioned between the bulb and a battery or behind the battery, or batteries, with the battery in contact with the rearward end of the bulb.

The pressure bearing contact method has several disadvantages when conventionally known pen light bulbs are employed. Pen light bulbs typically do not have wide lips on the metallic housing adjacent the transparent protective cover. Therefore the pressure bearing contact must occur against the transparent protective cover. These conventionally known bulbs are designed with a fairly long narrow portion at the outward extent of the transparent protective cover where the optical focusing portion is located. This contour arrangement provides for an extremely unstable mounting of the bulb wherein tipping may easily occur. Additionally, the base of conventionally known pen light bulbs have a relatively small diametric measurement. This small size of the base is even more pronounced when threads are positioned on the pen light bulb. This narrow base tends to increase the tendency of the bulb to tip out of alignment with the central axis of the pen light flashlight. This tipping tendency is even more pronounced when the spring is positioned against the bulb, which is the most common placement position.

As can be seen various attempts have been made to provide for a pen light bulb which may be utilized within conventionally known pen light flashlights. Typically, manufacturers are willing to accept that the axis of the beam of projected light does not match the central axis of the pen light flashlight proper. Previously, it has been necessary to increase production cost by utilizing a more complicated housing design in order to eliminate the out of alignment beam of projected light. These attempts have been less efficient than desired. As such, it may be appreciated that there continues to be a need for a pen light bulb which may be installed into existing pen light flashlight designs where a truer alignment occurs than that previously possible with conventional pen light bulbs. The present invention substantially fulfills these needs.

SUMMARY

In view of the foregoing disadvantages inherent in the known types of pen light bulbs, your applicants have devised a method of providing for a proper alignment of a pen light bulb in conventional pen light flashlights wherein the configuration of the bulb provides for the proper alignment. A self aligning pen light bulb produces a beam of light in response to an introduction of a power flow. The self aligning pen light bulb has a housing, having a first power coupling thereon, a second power coupling, an insulator, a filament and a focusing lens protective element. The housing has a circular body and a circular base. The circular body has an upper extent having an opening thereat. The circular base is positioned distal from the upper extent of the circular body. The circular base is generally planar with an aperture therethrough. The housing has an interior and an exterior with at least a portion of the exterior forming the first power coupling which provides for a passage of the power flow from the exterior to the interior. The housing also has a central axis through the interior of the housing and extending from a central position of the circular base to a central position of the opening at the upper extent. The second power coupling is positioned to extend from the exterior of the circular base and generally aligned with the central axis of the housing. The second power coupling provides for a passage of the power flow to the interior of the housing. The insulator is positioned between the second power coupling and the exterior of the circular base to prevent passage of the power flow between the second power coupling and the exterior of the housing. The filament is in communication with the first power coupling and the second power coupling. The filament produces a light during the introduction of the power flow. The focusing lens protective element has a focusing portion, an upper tapered portion, a lower tapered portion and a mounting portion. The focusing portion has optical qualities to provide for a focusing of the light produced by the filament. The focusing portion is radially disposed about the central axis of the housing distal from the housing. The upper tapered portion is radially disposed about the central axis of the housing and extends from the focusing portion toward the housing. The upper tapered portion has an angle of taper extending outward from the focusing portion toward the housing. The lower tapered portion is radially disposed about the central axis of the housing and extends from the upper tapered portion toward the housing. The lower tapered portion has an angle of taper extending outward from the upper tapered portion toward the housing. The angle of taper of the lower tapered portion is significantly greater than the angle of taper of the upper tapered portion. The mounting portion extends from the lower tapered portion into the interior of the housing.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a self aligning pen light bulb which may be employed in existing pen light flashlights.

Other objects include;

a) to provide for a better seating surface on the transparent protective element of the pen light bulb than that which exists on conventional pen light bulbs.

b) to provide for a wider spring contact surface on the circular base of the pen light bulb than that which exists on conventional pen light bulbs.

c) to provide for a spring contact surface on the circular base of the pen light bulb with a significantly greater area than that which exists on conventional pen light bulbs.

d) to provide for a wider focusing portion on the transparent protective element of the pen light bulb than that which exists on conventional pen light bulbs.

e) to provide for a housing having a circular body with a larger diametric measurement than that which exists on conventional pen light bulbs.

f) to provide for easier manufacture of the pen light bulb by providing for a larger interior of the circular body of the pen light bulb than that which exists on conventional pen light bulbs.

g) to provide for an upper tapered portion and a lower tapered portion on the focusing lens protective element with generally equal lengths along the central axis of the pen light bulb.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 4 is an elevational view of the self aligning pen light bulb shown in FIG. 1 with various portions cutaway to reveal the internal arrangement.

FIG. 5 is a bottom plan view of a spring and labeled as 'Prior Art'.

DESCRIPTION

Figure 1:
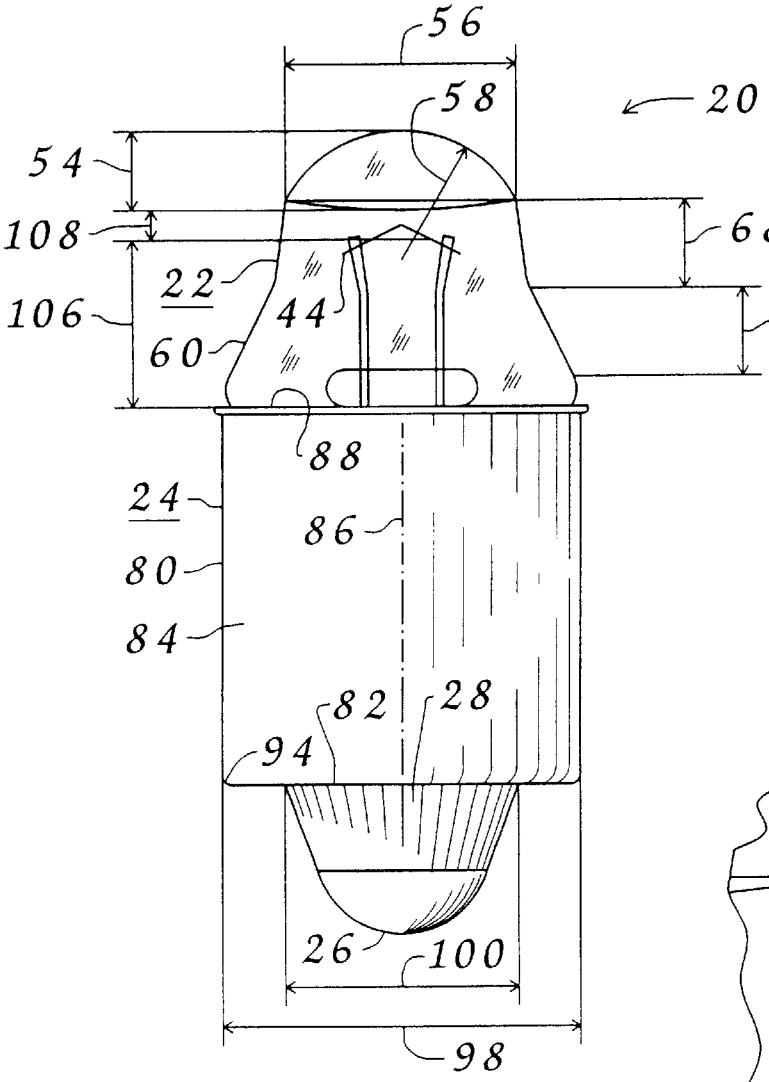
FIG. 1 is an elevational view of a self aligning pen light bulb.
Figure 2:
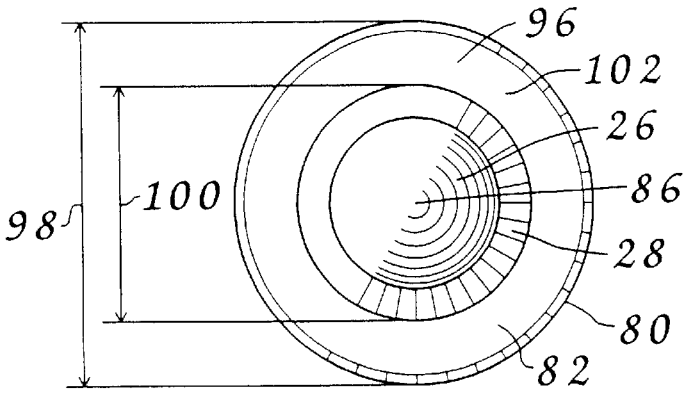
FIG. 2 is a bottom plan view of the self aligning pen light bulb shown in FIG. 1.
Figure 3:
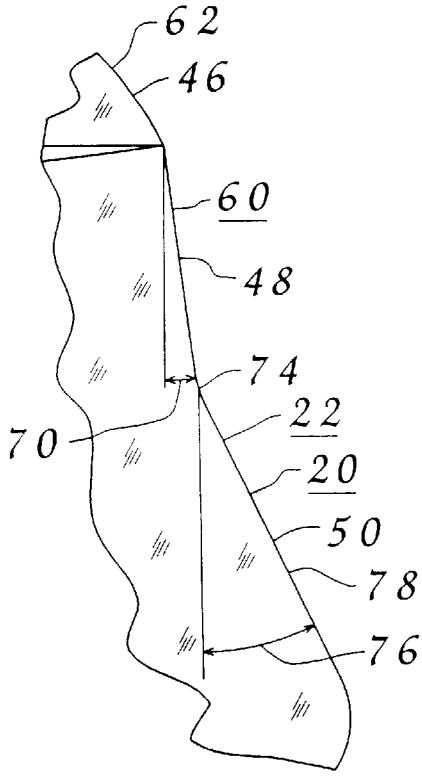
FIG. 3 is an enlarged partial view as taken from FIG. 1.

Many different pen light bulbs having features of the present invention are possible. The following description describes the preferred embodiment of select features of those bulbs. These features may be deployed in various combinations to arrive at various desired working configurations of pen light bulbs.

Reference is hereafter made to the drawings where like reference numerals refer to like parts throughout the various views.

Self Aligning Bulb Construction

FIG. 1 through FIG. 4 depict a self aligning pen light bulb 20, or portions thereof, having features of the present invention. Self aligning pen light bulb 20 has a glass envelope 22, a housing 24 and a power coupling 26. Power coupling 26 is separated from housing 24 by an insulator 28. Glass envelope 22 rests within housing 24 and is secured therein by material of insulator 28 which preferably extends into housing 24 to surround a terminal end 30 of glass envelope 22. Glass envelope 22 is a sealed unit having a first electric lead 32 and a second electric lead 34 extending from terminal end 30 thereof, see FIG. 4. First electric lead 32 connects to an interior 36 of housing 24. Second electric lead 34 connects to power coupling 26.

Glass envelope 22 has positioned therein a first power pole 38 connected to first electric lead 32 and a second power pole 40 connected to second electric lead 34. A spacing insulator 42 retains first power pole 38 and second power pole 40 in spaced relationship within glass envelope 22. A filament 44 is connected to span the gap between first power pole 38 and second power pole 40. Filament 44 produces a light when power passes therethrough. Glass envelope 22 is a continuous sealed transparent member and has a focusing portion 46, an upper tapered portion 48, a lower tapered portion 50 and a mounting portion 52.

Focusing portion 46 is radially disposed and has a maximum thickness 54 and a diametric width 56. Focusing portion 46 further has a radius 58 at an exterior 60 of glass envelope 22. Focusing portion 46 forms an optical focusing lens 62 to focus light produced by filament 44 into a beam of light 64, see FIG. 9, having an axis of projection 66. Preferably maximum thickness 54 of focusing portion 46 is between one and eight tenths (1.8) millimeters and one and nine tenths (1.9) millimeters while diametric width 56 of focusing portion 46 is between six (6.0) millimeters and six and two tenths (6.2) millimeters while radius 58 of focusing portion 46 is between three and thirty five hundredths (3.35) millimeters and three and fifty five hundredths (3.55) millimeters. More preferably maximum thickness 54 of focusing portion 46 is one and eighty five hundredths (1.85) millimeters while diametric width 56 of focusing portion 46 is six and one tenth (6.1) millimeters while radius 58 of focusing portion 46 is three and forty five hundredths (3.45) millimeters.

Upper tapered portion 48 has a thin wall construction and is radially disposed to extend downward from focusing portion 46 a depth 68. Upper tapered portion 48 has an angle of offset 70, see FIG. 3. Preferably depth 68 of upper tapered portion 48 is between two and two tenths (2.2) millimeters and two and four tenths (2.4) millimeters while angle of offset 70 of upper tapered portion 48 is between seven (7.0) degrees and eight (8.0) degrees. More preferably depth 68 of upper tapered portion 48 is two and three tenths (2.3) millimeters while angle of offset 70 of upper tapered portion 48 is seven and one half (7.5) degrees.

Lower tapered portion 50 has a thin wall construction and is radially disposed to extend downward from upper tapered portion 48 a depth 72. A transition 74 exists between upper tapered portion 48 and lower tapered portion 50. Lower tapered portion 50 has an angle of offset 76, see FIG. 3, which is significantly greater than angle of offset 70 of upper tapered portion 48. Ideally during mounting within a pen flashlight contact between self aligning pen light bulb 20 and the body of the pen flashlight will occur at lower tapered portion 50 with a portion of lower tapered portion 50 forming a seating surface 78, see FIG. 3 and FIG. 11. Preferably depth 72 of lower tapered portion 50 is between two and one tenth (2.1) millimeters and two and three tenths (2.3) millimeters while angle of offset 76 of lower tapered portion 50 is between twenty five (25.0) degrees and twenty seven (27.0) degrees. More preferably depth 72 of lower tapered portion 50 is two and two tenths (2.2) millimeters while angle of offset 76 of lower tapered portion 50 is twenty six (26.0) degrees.

Mounting portion 52 generally has a thin wall construction and is radially disposed to extend downward from lower tapered portion 50. Mounting portion 52 is sealed at terminal end 30 during manufacture of glass envelope 22.

Housing 24 has a circular body 80 and a circular base 82. Housing 24 further has interior 36, an exterior 84 and a central axis 86 extending therethrough. Circular base 82 has an aperture therethrough to which second electric lead 34 passes for connection to power coupling 26. Housing 24 preferably is constructed of a conductive material. First electric lead 32 attaches to interior 36 of housing 24, see FIG. 4. Circular body 80 has an upper extent 88 distal from circular base 82. Upper extent 88 radially defines an opening 90 which is closed by glass envelope 22. Insulator 28 prevents contact of second electric lead 34 with housing 24. Interior 36 of circular body 80 has a diameter 92, see FIG. 4. Preferably exterior 84 of circular body 80 is smooth. Preferably diameter 92 of interior 36 is between nine (9.0) millimeters and nine and two tenths (9.2) millimeters. More preferably diameter 92 of interior 36 is nine and one tenth (9.1) millimeters.

Circular base 82 of housing 24 is generally flat with a transition 94, which preferably is slightly rounded, between circular base 82 and circular body 80. A spring contact surface 96 is formed by circular base 82 outside of insulator 28. Spring contact surface 96 has an outer diametric measurement 98, an inner diametric measurement 100 and an area 102. Outer diametric measurement 98 generally matches a diameter of circular body 80 adjacent circular base 82. In practice, when the spring is positioned between the bulb and the battery, a spring 104, see FIG. 5 and FIG. 12 and labeled as 'Prior Art', ideally will rest completely on spring contact surface 96. Preferably outer diametric measurement 98 of spring contact surface 96 is between nine (9.0) millimeters and ten (10.0) millimeters while inner diametric measurement 100 of spring contact surface 96 is between six (6.0) millimeters and six and one half (6.5) millimeters with area 102 of spring contact surface 96 of between nine and four tenths (9.4) square millimeters and eleven (11.0) square millimeters. More preferably outer diametric measurement 98 of spring contact surface 96 is nine and one half (9.5) millimeters while inner diametric measurement 100 of spring contract surface 96 is six and one quarter (6.25) millimeters with area 102 of spring contact surface 96 of approximately ten and two tenths (10.2) square millimeters.

Filament 44 has an average height 106 from the closest approach of housing 24. Additionally, filament 44 has an average spacing 108 from the closest approach of focusing portion 46. Preferably average height 106 is between four and thirty five hundredths (4.35) millimeters and four and fifty five hundredths (4.55) millimeters while average spacing 108 is between seven tenths (0.7) millimeters and nine tenths (0.9) millimeters. More preferably average height 106 is four and forty five hundredths (4.45) millimeters while average spacing 108 is eight tenths (0.8) millimeters.

Prior Art Bulb Construction

Figure 6:
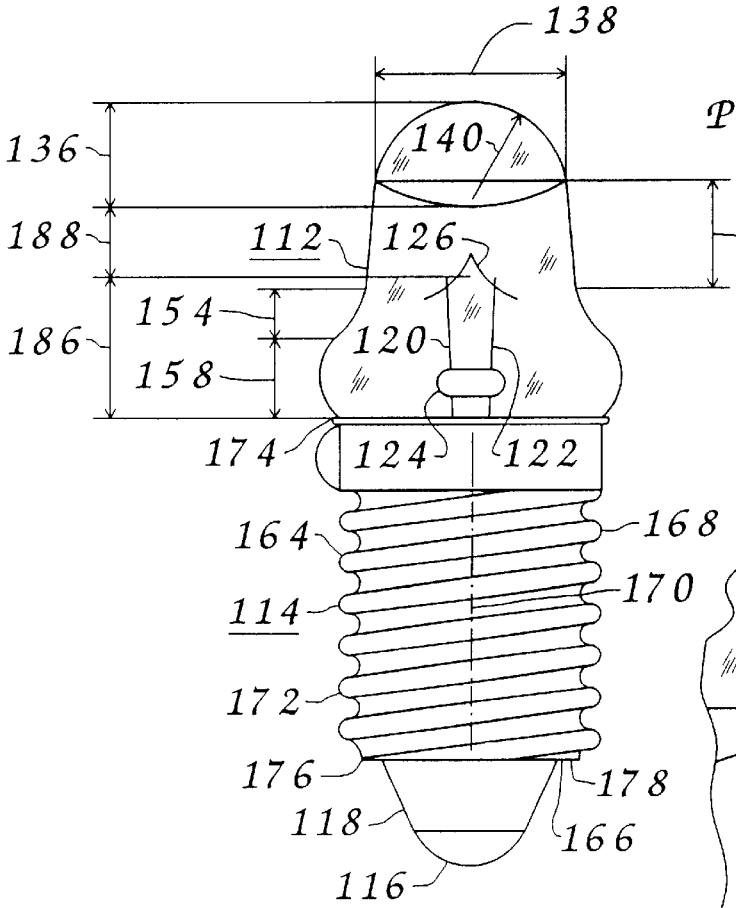
FIG. 6 PRIOR ART
FIG. 6 is an elevational view of a conventional pen light bulb and labeled as 'Prior Art'.
Figure 7:
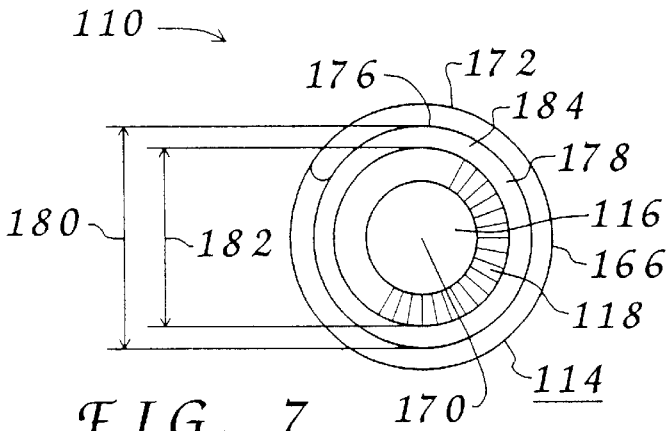
FIG. 7 PRIOR ART
FIG. 7 is a bottom plan view of the conventional pen light bulb shown in FIG. 6 and labeled as 'Prior Art'.
Figure 8:
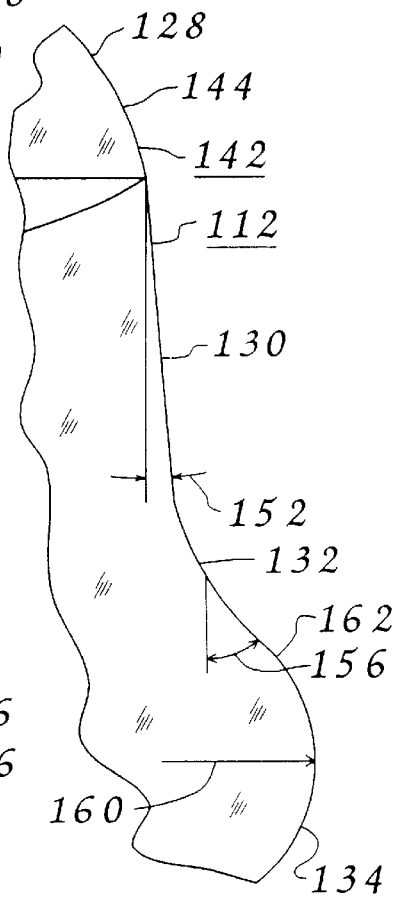
FIG. 8 PRIOR ART
FIG. 8 is an enlarged partial view as taken from FIG. 6 and labeled as 'Prior Art'.

FIG. 6 through FIG. 8 depict a pen light bulb 110, or portions thereof, as conventionally known in the art and labeled as 'Prior Art'. Pen light bulb 110 is comparable to the present invention. While various sizes exist for such known pen light bulbs, applicants feel that the bulb depicted, including the dimensions recited below, are representative of the state of the art. Pen light bulb 110 has a glass envelope 112, a housing 114 and a power coupling 116. Power coupling 116 is separated from housing 114 by an insulator 118. Glass envelope 112 rests within housing 114 and is secured therein by material of insulator 118 which preferably extends into housing 114 to surround a terminal end, not shown, of glass envelope 112. Glass envelope 112 is a sealed unit having electric leads as conventionally known in the art. These electric leads connects to the interior of housing 114 and to power coupling 116 respectively.

Glass envelope 112 has positioned therein a first power pole 120 connected to one of the electric leads and a second power pole 122 connected to the other electric lead. A spacing insulator 124 retains first power pole 120 and second power pole 122 in spaced relationship within glass envelope 112. A filament 126 is connected to span the gap between first power pole 120 and second power pole 122. Filament 126 produces a light when power passes therethrough. Glass envelope 112 is a continuous sealed transparent member and has a focusing portion 128, an upper tapered portion 130, a lower outward tapered portion 132, a lower inward tapered portion 134 and a mounting portion, not shown, and which is contained within housing 114.

Focusing portion 128 is radially disposed and has a maximum thickness 136 and a diametric width 138. Focusing portion 128 further has a radius 140 at an exterior 142 of glass envelope 112. Focusing portion 128 forms an optical focusing lens 144 to focus light produced by filament 126 into a beam of light 146, see FIG. 10, having an axis of projection 148. Maximum thickness 136 of focusing portion 128 is two and nine tenths (2.9) millimeters while diametric width 138 of focusing portion 128 is five and four tenths (5.4) millimeters while radius 140 of focusing portion 128 is two and seven tenths (2.7) millimeters.

Upper tapered portion 130 has a thin wall construction and is radially disposed to extend downward from focusing portion 128 a depth 150. Upper tapered portion 130 has an angle of offset 152, see FIG. 8. Depth 150 of upper tapered portion 130 is three (3.0) millimeters while angle of offset 152 of upper tapered portion 130 is five (5.0) degrees.

Lower outward tapered portion 132 has a thin wall construction and is radially disposed to extend downward from upper tapered portion 130 a depth 154. Lower outward tapered portion 132 has an angle of offset 156, see FIG. 8, which is significantly greater than angle of offset 152 of upper tapered portion 130. Depth 154 of lower outward tapered portion 132 is one and four tenths (1.4) millimeters while angle of offset 156 of lower outward tapered portion 132 is thirty nine (39.0) degrees.

Lower inward tapered portion 134 has a thin wall construction and is radially disposed to extend downward from lower outward tapered portion 132 a depth 158 to housing 114. Lower inward tapered portion 134 has a radius 160, see FIG. 8. Depth 158 of lower inward tapered portion 134 is two and two tenths (2.2) millimeters while radius 160 is four and thirty five hundredths (4.35) millimeters. During mounting within a pen flashlight contact between pen light bulb 110 and the body of the pen flashlight typically occurs at lower inward tapered portion 134 with a portion of lower inward tapered portion 134 forming a seating surface 162, see FIG. 8 and FIG. 12.

The mounting portion, not shown, generally has a thin wall construction and is radially disposed to extend downward from lower inward tapered portion 134.

Housing 114 has a circular body 164 and a circular base 166. Housing 114 further has interior 36, an exterior 168 and a central axis 170 extending therethrough. Exterior 168 has threads 172 positioned thereon which are not utilized for mounting when used in pen light flashlights applicable to the present invention. Circular body 164 has an upper extent 174 distal from circular base 166. Upper extent 174 radially defines an opening, not shown, which is closed by glass envelope 112.

Circular base 166 of housing 114 is generally flat with a transition 176, which preferably is slightly rounded, between circular base 166 and circular body 164. A spring contact surface 178 is formed by circular base 166 outside of insulator 118. Spring contact surface 178 has an outer diametric measurement 180, an inner diametric measurement 182 and an area 184. In practice, when the spring is positioned between the bulb and the battery, a portion of spring 104, see FIG. 5 and FIG. 12, often will tip off of spring contact surface 178 onto threads 172. Outer diametric measurement 180 of spring contact surface 178 is six and fifteen hundredths (6.15) millimeters while inner diametric measurement 182 of spring contract surface 178 is five (5.0) millimeters with area 184 of spring contact surface 178 of approximately three and six tenths (3.6) square millimeters.

Filament 126 has an average height 186 from the closest approach of housing 114. Additionally, filament 126 has an average spacing 188 from the closest approach of focusing portion 128. Average height 186 is three and nine tenths (3.9) millimeters while average spacing 188 is two (2.0) millimeters.

Bulb Comparisons

Utilizing sizes and general shapes from the most preferred embodiment of self aligning pen light bulb 20 of the present invention we find various stark comparisons to the actual sizes of the example prior art pen light bulb 110. The following relates to three primary areas of comparison. Many other differences are readily apparent. The first specific area involves the portion of the glass envelope extending out of the respective housing. The second specific area involves the housing in general and the respective circular base in specific. The third specific area involves placement of the filament relative to the respective optical focusing lens and the configuration of the respective optical focusing lens. These third specific groups of comparisons follow.

As can be readily observed the respective glass envelopes 22 and 112 are radically different. The improvements made to glass envelope 22 are intended to provide a more stable seating surface 78 for engagement of the body of the pen light flashlight. Seating surface 78 resides on lower tapered portion 50 which has angle of offset 76. Depth 72 of lower tapered portion 50 is fairly long and which is two and two tenths (2.2) millimeters, with a uniform taper therealong which provides an excellent opportunity to properly seat on the portion of the pen light flashlight. This compares to seating surface 162 which resides on lower outward tapered portion 132 which has angle of offset 156. Lower outward tapered portion 132 is fairly shallow, depth 154 which is only one and four tenths (1.4) millimeters. Incorporation of lower inward tapered portion 134 eliminates an opportunity to properly seat on the portion of the pen light flashlight.

As can be readily observed the respective circular bases 82 and 166 are radically different. The improvements made to housing 24 generally and circular base 82 specifically are intended to provide a more stable spring contact surface 96 for engagement of spring 104 while in the pen light flashlight. Spring contact surface 96 has area 102 which is ten and two tenths (10.2) square millimeters while spring contact surface 178 has area 184 which is only three and six tenths (3.6) square millimeters. This radical difference is accomplished despite the fact that insulator 28 consumes a greater area, inner diametric measurement 100, which is six and one quarter (6.25) millimeters, than insulator 118 which has inner diametric measurement 182, which is only five (5.0) millimeters. This is accomplished by expanding spring contact surface 96 out to outer diametric measurement 98, which is nine and one half (9.5) millimeters, compared to spring contact surface 178 which only extends out to outer diametric measurement 180, which is a mere six and fifteen hundredths (6.15) millimeters. Pen light bulb 110 relies upon the spring making contact with threads 172 which causes a tipping or twisting of pen light bulb 110 within the pen light flashlight. This action can, and often does, cause a short circuit which causes pen light bulb 110 not to function to produce light.

As can be readily observed the optical focusing lens 62 and 144 are radically different as is the placement of filament 44 and 126 to the respective optical focusing lens 62 and 144. The improvements made to optical focusing lens 62 and the placement of filament 44 therebeneath are intended to provide for production of an acceptable beam of light 64. Diametric width 56, which is six and one tenth (6.1) millimeters, and maximum thickness 54, which is one and eighty five hundredths (1.85) millimeters, of focusing portion 46 provide for a broader thinner lens when compared to diametric width 138, which is five and four tenths (5.4) millimeters, and maximum thickness 136, which is two and nine tenths (2.9) millimeters, of focusing portion 128. This provides for a closer average spacing 108, which is eight tenths (0.8) millimeters, of filament 44 to focusing portion 46 compared to average spacing 188, which is two (2.0) millimeters, of filament 126 to focusing portion 128. These improvements provide for production of a comparable beam of light 64 compared to beam of light 146.

Bulb Alignment

Figure 9:
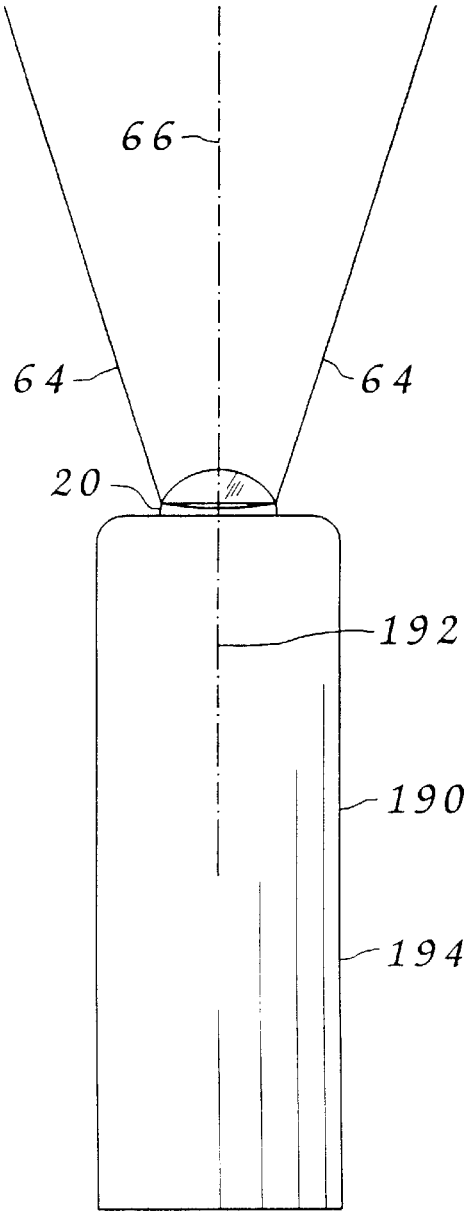
FIG. 9 is an elevational view of an upper portion of a pen light flashlight having the self aligning pen light bulb shown in FIG. 1 installed therein.
Figure 10:
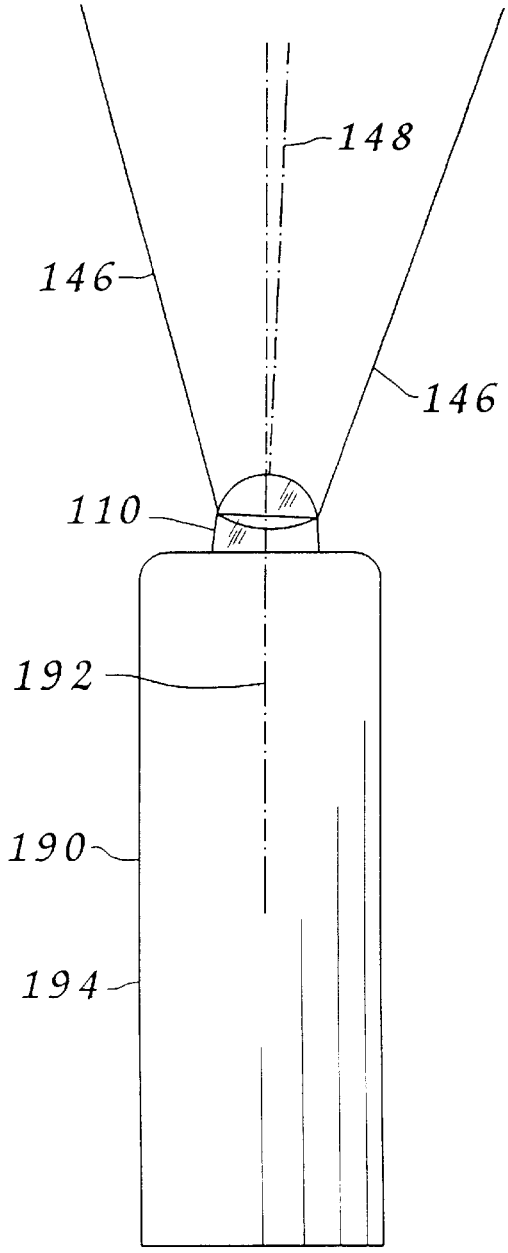
FIG. 10 PRIOR ART
FIG. 10 is an elevational view of the upper portion of the pen light flashlight shown in FIG. 9 having the conventional pen light bulb shown in FIG. 4 installed therein and labeled as 'Prior Art'.
Figure 11:
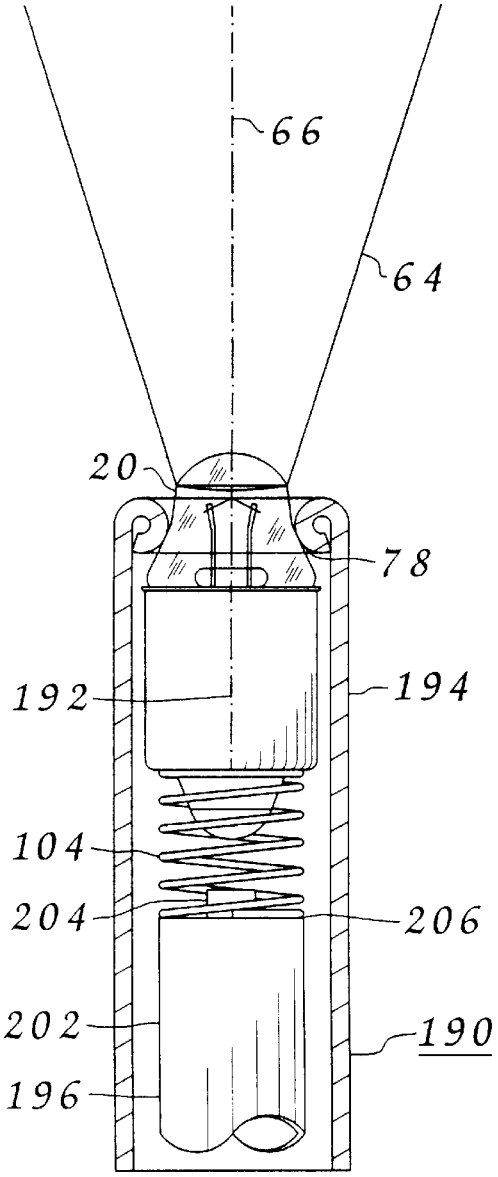
FIG. 11 is a sectional view of the upper portion of the pen light flashlight shown in FIG. 9 with part of the housing cutaway.
Figure 12:
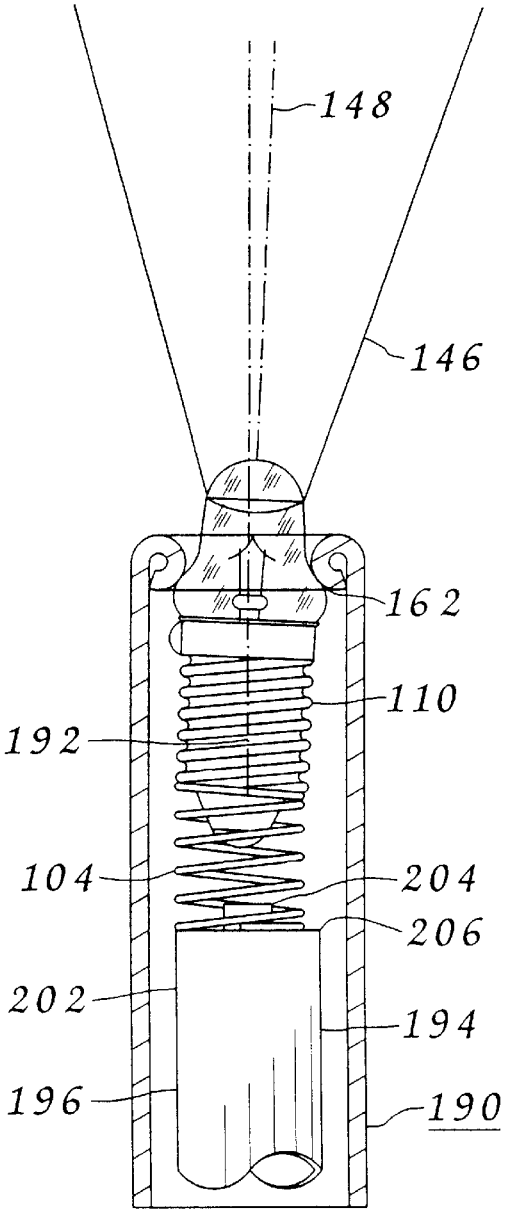
FIG. 12 PRIOR ART
FIG. 12 is a sectional view of the upper portion of the pen light flashlight shown in FIG. 10 with part of the housing cutaway and labeled as 'Prior Art'.

FIG. 9 through FIG. 12 depict an upper portion of a pen light flashlight 190 as conventionally known in the art. The remainder of pen light flashlight 190 is not particularly relevant to the present invention. FIG. 9 and FIG. 11 depict self aligning pen light bulb 20 positioned within pen light flashlight 190. FIG. 10 and FIG. 12 depict pen light bulb 110 positioned within pen light flashlight 190 and labeled as 'Prior Art'. Pen light flashlight 190 has a central axis 192 extending therethrough which is the desired path of projection of a beam of light produced by pen light flashlight 190.

Pen light flashlight 190, as conventionally known in the art, has a housing 194, a battery 196 and spring 104. Pen light flashlight 190 has self aligning pen light bulb 20 installed therein in FIG. 9 and FIG. 11. Pen light flashlight 190 has pen light bulb 110 installed therein in FIG. 10 and FIG. 12 and labeled as 'Prior Art'. FIG. 9 and FIG. 11 depict the desired alignment of axis of projection 66 of beam of light 64 with central axis 192, which is a pointing axis, of pen light flashlight 190. This results from proper alignment of self aligning pen light bulb 20 within pen light flashlight 190, see FIG. 11. FIG. 10 and FIG. 12 depict the conventionally known problem wherein axis of projection 148 of beam of light 146 fails to align with central axis 192 of pen light flashlight 190. This results from improper alignment of pen light bulb 110 within pen light flashlight 190, see FIG. 12. Often this misalignment problem will be even more pronounced than depicted in FIG. 10 and FIG. 12.

Battery 196, see FIG. 11 and FIG. 12, has a diameter 198 which is standardized within the industry for pen light flashlights. Spring 104, see FIG. 5, has a diameter 200 which typically matches diameter 198 of battery 196. Selection of diameter 200 of spring 104 within the industry for use in pen light flashlights is the result of construction of battery 196 which has a metallic housing 202 which covers the entire body of battery 196 with the exception of the central region of one end and a power post 204 centered within the central region of the one end. This provides for conductive contact with power post 204 and any part of metallic housing 202 to allow for transfer of power from battery 196. Diameter 200 of spring 104 allows contact with a terminal end 206 of battery 196 while surrounding power post 204 without making contact with power post 204. This provides for spring 104 to act as a conduit for the transfer of power.

Spring contact surface 178 of pen light bulb 110 fails to adequately support spring 104 squarely and therefore pen light bulb 110 may move out of alignment within pen light flashlight 190, as currently commonly occurs. This improper off balanced placement of spring 104 relative to pen light bulb 110 also tends to cause spring 104 to become improperly aligned relative to battery 196. This improper alignment of spring 104 to battery 196 may cause a short circuit where spring 104 makes contact with metallic housing 202 and power post 204. In comparison spring contact surface 96 of self aligning pen light bulb 20 adequately supports spring 104 squarely and therefore self aligning pen light bulb 20 tends to remain aligned within pen light flashlight 190. This proper uniform placement of spring 104 relative to self aligning pen light bulb 20 also tends to assist spring 104 to remain properly aligned relative to battery 196.

Seating surface 162 of pen light bulb 110 fails to adequately support pen light bulb 110 within pen light flashlight 190. The nature of seating surface 162 allows easy rotation of pen light bulb 110 within pen light flashlight 190 about central axis 192. In comparison seating surface 78 of self aligning pen light bulb 20 adequately supports self aligning pen light bulb 20 within pen light flashlight 190. Seating surface 78 actually causes self aligning pen light bulb 20 to move into proper alignment during placement into pen light flashlight 190, or other similar flashlights. The nature of seating surface 78 resists rotation of self aligning pen light bulb 20 within pen light flashlight 190 about central axis 192.

The superior seating surface, for proper placement and retention within the pen light flashlight, and the superior spring contact surface, for proper placement of the spring, combine to provide for inexpensive pen light flashlights having co-axial pointing characteristics previously found only on more expensive pen light flashlights.

Figure 13:
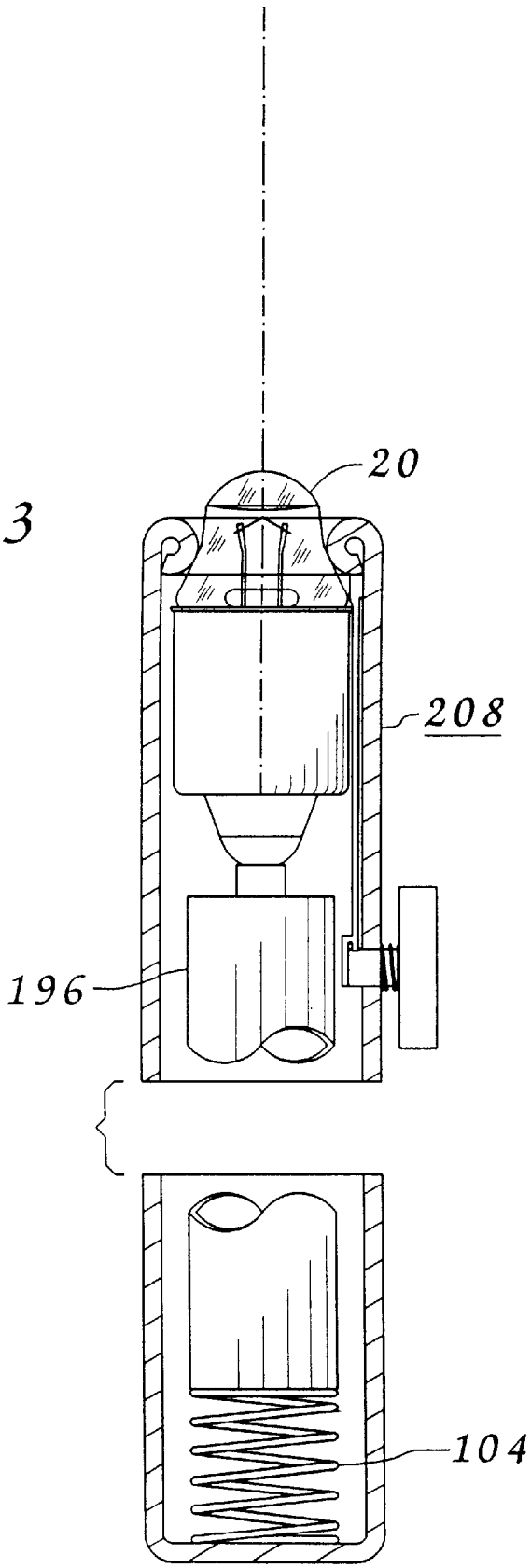
FIG. 13 is an exploded elevational sectional view of a pen light flashlight having the self aligning pen light bulb shown in FIG. 1 installed therein.

FIG. 13 depicts a pen light flashlight 208 having self aligning pen light bulb 20 positioned therein. Pen light flashlight 208 is of a type wherein battery 196 is held in direct contact with self aligning pen light bulb 20 by spring 104. Self aligning pen light bulbs having features of the present invention acts to provide for proper placement and retention within this type of pen light flashlight as well.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A self aligning pen light bulb to provide for a production of a beam of light in response to an introduction of a power flow, the self aligning pen light bulb comprising:

a) a housing having a circular body and a circular base, the circular body having an upper extent having an opening thereat, the circular base positioned distal from the opening at the upper extent of the circular body, the circular base generally planar with an aperture therethrough, the housing having an interior and an exterior, at least a portion of the exterior forming a first power coupling to provide for a passage of the power flow from the exterior of the housing to the interior of the housing, the housing having a central axis through the interior of the housing and extending from a central position on the circular base to a central position of the opening at the upper extent and wherein the circular base further has a spring contact surface and wherein the spring contact surface of the circular base has an area of between nine and four tenths square millimeters and eleven square millimeters;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a filament in communication with the first power coupling and the second power coupling, the filament to produce a light during the introduction of the power flow;

e) a focusing lens protective element having a focusing portion, an upper tapered portion, a lower tapered portion and a mounting portion, the focusing portion having optical qualities to provide for a focusing of the light produced by the filament, the focusing portion radially disposed about the central axis of the housing distal from the housing, the upper tapered portion radially disposed about the central axis of the housing, the upper tapered portion extending from the focusing portion toward the housing, the upper tapered portion having an angle of taper extending outward from the focusing portion toward the housing, the lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion, the mounting portion extending from the lower tapered portion into the interior of the housing.

2. A self aligning pen light bulb to provide for a production of a beam of light in response to an introduction of a power flow, the self aligning pen light bulb comprising:

a) a housing having a circular body and a circular base, the circular body having an upper extent having an opening thereat, the circular base positioned distal from the opening at the upper extent of the circular body, the circular base generally planar with an aperture therethrough, the housing having an interior and an exterior, at least a portion of the exterior forming a first power coupling to provide for a passage of the power flow from the exterior of the housing to the interior of the housing, the housing having a central axis through the interior of the housing and extending from a central position on the circular base to a central position of the opening at the upper extent;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a filament in communication with the first power coupling and the second power coupling, the filament to produce a light during the introduction of the power flow;

e) a focusing lens protective element having a focusing portion, an upper tapered portion, a lower tapered portion and a mounting portion, the focusing portion having optical qualities to provide for a focusing of the light produced by the filament, the focusing portion radially disposed about the central axis of the housing distal from the housing, and wherein the focusing portion has a diametric measurement of between six millimeters and six and two tenths millimeters, the upper tapered portion radially disposed about the central axis of the housing, the upper tapered portion extending from the focusing portion toward the housing, the upper tapered portion having an angle of taper extending outward from the focusing portion toward the housing, the lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion, the mounting portion extending from the lower tapered portion into the interior of the housing.

3. A self aligning pen light bulb to provide for a production of a beam of light in response to an introduction of a power flow, the self aligning pen light bulb comprising:

a) a housing having a circular body and a circular base, the circular body having an upper extent having an opening thereat, the circular base positioned distal from the opening at the upper extent of the circular body, the circular base generally planar with an aperture therethrough, the housing having an interior and an exterior, at least a portion of the exterior forming a first power coupling to provide for a passage of the power flow from the exterior of the housing to the interior of the housing, the housing having a central axis through the interior of the housing and extending from a central position on the circular base to a central position of the opening at the upper extent;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a filament in communication with the first power coupling and the second power coupling, the filament to produce a light during the introduction of the power flow;

e) a focusing lens protective element having a focusing portion, an upper tapered portion, a lower tapered portion and a mounting portion, the focusing portion having optical qualities to provide for a focusing of the light produced by the filament, the focusing portion radially disposed about the central axis of the housing distal from the housing, and wherein the focusing portion has a diametric measurement of between six millimeters and six and two tenths millimeters, the upper tapered portion radially disposed about the central axis of the housing, the upper tapered portion extending from the focusing portion toward the housing, the upper tapered portion having an angle of taper extending outward from the focusing portion toward the housing, the lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion, the mounting portion extending from the lower tapered portion into the interior of the housing.

4. A self aligning pen light bulb to provide for a production of a beam of light in response to an introduction of a power flow, the self aligning pen light bulb comprising:

a) a housing having a circular body and a circular base, the circular body having an upper extent having an opening thereat, the circular base positioned distal from the opening at the upper extent of the circular body, the circular base generally planar with an aperture therethrough, the housing having an interior and an exterior, at least a portion of the exterior forming a first power coupling to provide for a passage of the power flow from the exterior of the housing to the interior of the housing, the housing having a central axis through the interior of the housing and extending from a central position on the circular base to a central position of the opening at the upper extent;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a filament in communication with the first power coupling and the second power coupling, the filament to produce a light during the introduction of the power flow;

e) a focusing lens protective element having a focusing portion, an upper tapered portion, a lower tapered portion and a mounting portion, the focusing portion having optical qualities to provide for a focusing of the light produced by the filament, the focusing portion radially disposed about the central axis of the housing distal from the housing, the upper tapered portion radially disposed about the central axis of the housing, the upper tapered portion extending from the focusing portion toward the housing, the upper tapered portion having an angle of taper extending outward from the focusing portion toward the housing, the lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion, the mounting portion extending from the lower tapered portion into the interior of the housing and wherein the filament has an average measurement of spacing from a base of the focusing portion of the focusing lens protective element of between seventy five hundredths millimeters and eighty five hundredths millimeters.

5. A self aligning pen light bulb to provide for a production of a beam of light in response to an introduction of a power flow, the self aligning pen light bulb comprising:

a) a housing having a circular body and a circular base, the circular body having an upper extent having an opening thereat, the circular base positioned distal from the opening at the upper extent of the circular body, the circular base generally planar with an aperture therethrough, the housing having an interior and an exterior, at least a portion of the exterior forming a first power coupling to provide for a passage of the power flow from the exterior of the housing to the interior of the housing, the housing having a central axis through the interior of the housing and extending from a central position on the circular base to a central position of the opening at the upper extent;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a filament in communication with the first power coupling and the second power coupling, the filament to produce a light during the introduction of the power flow;

e) a focusing lens protective element having a focusing portion, an upper tapered portion, a lower tapered portion and a mounting portion, the focusing portion having optical qualities to provide for a focusing of the light produced by the filament, the focusing portion radially disposed about the central axis of the housing distal from the housing, and wherein the focusing portion of the focusing lens protective element has an outer radius measurement of between three and four tenths millimeters and three and one half millimeters, the upper tapered portion radially disposed about the central axis of the housing, the upper tapered portion extending from the focusing portion toward the housing, the upper tapered portion having an angle of taper extending outward from the focusing portion toward the housing, the lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion, the mounting portion extending from the lower tapered portion into the interior of the housing.

6. A self aligning pen light bulb to provide for a production of a beam of light in response to an introduction of a power flow, the self aligning pen light bulb comprising:

a) a housing having a circular body and a circular base, the circular body having an upper extent having an opening thereat, the circular base positioned distal from the opening at the upper extent of the circular body, the circular base generally planar with an aperture therethrough, the housing having an interior and an exterior, at least a portion of the exterior forming a first power coupling to provide for a passage of the power flow from the exterior of the housing to the interior of the housing, the housing having a central axis through the interior of the housing and extending from a central position on the circular base to a central position of the opening at the upper extent;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a filament in communication with the first power coupling and the second power coupling, the filament to produce a light during the introduction of the power flow and wherein the filament has an average measurement of spacing from the upper extent of the circular body of the housing of between four and thirty-five hundredths millimeters and four and fifty-five hundredths millimeters;

e) a focusing lens protective element having a focusing portion, an upper tapered portion, a lower tapered portion and a mounting portion, the focusing portion having optical qualities to provide for a focusing of the light produced by the filament, the focusing portion radially disposed about the central axis of the housing distal from the housing, the upper tapered portion radially disposed about the central axis of the housing, the upper tapered portion extending from the focusing portion toward the housing, the upper tapered portion having an angle of taper extending outward from the focusing portion toward the housing, the lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion, the mounting portion extending from the lower tapered portion into the interior of the housing.

7. A self aligning pen light bulb to provide for a production of a beam of light in response to an introduction of a power flow, the self aligning pen light bulb comprising:

a) a housing having:

1) a circular body having an upper extent having an opening thereat, the upper extent having a lip radially disposed about the opening to extend outward from the opening;

2) a circular base positioned distal from the opening at the upper extent of the circular body, the circular base generally planar with an aperture therethrough;

3) an interior formed by the circular body and closed by the circular base;

4) an exterior formed by the circular body and the circular base with at least a portion of the exterior forming a first power coupling to provide for a passage of the power flow from the exterior of the housing to the interior of the housing;

5) a central axis through the interior of the housing and extending from a central position on the circular base to a central position of the opening at the upper extent;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a first power pole positioned within the interior of the housing and in communication with the first power coupling;

e) a second power pole positioned within the interior of the housing and in communication with the second power coupling;

f) a spacing insulator contacting the first power pole and the second power pole at a generally mid positioned thereon to retain the first power pole and the second power pole at a desired spacing within the interior of the housing;

g) a filament extending from an upper extent of the first power pole to an upper extent of the second power pole, the filament to produce a light during the introduction of the power flow to pass between the first power pole and the second power pole;

h) a focusing lens protective element comprising:

1) a focusing portion having optical qualities to provide for a focusing of the light produced by the filament, the focusing portion radially disposed about the central axis of the housing distal from the housing;

2) an upper tapered portion radially disposed about the central axis of the housing, the upper tapered portion extending from the focusing portion toward the housing, the upper tapered portion having an angle of taper extending outward from the focusing portion toward the housing and wherein the angle of taper of the upper tapered portion is between seven degrees and eight degrees from the central axis of the housing;

3) a lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion;

4) a mounting portion extending from the lower tapered portion into the interior of the housing.

8. A self aligning pen light bulb to provide for a production of a beam of light in response to an introduction of a power flow, the self aligning pen light bulb comprising:

a) a housing having:

1) a circular body having an upper extent having an opening thereat, the upper extent having a lip radially disposed about the opening to extend outward from the opening;

2) a circular base positioned distal from the opening at the upper extent of the circular body, the circular base generally planar with an aperture therethrough;

3) an interior formed by the circular body and closed by the circular base;

4) an exterior formed by the circular body and the circular base with at least a portion of the exterior forming a first power coupling to provide for a passage of the power flow from the exterior of the housing to the interior of the housing;

5) a central axis through the interior of the housing and extending from a central position on the circular base to a central position of the opening at the upper extent;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a first power pole positioned within the interior of the housing and in communication with the first power coupling;

e) a second power pole positioned within the interior of the housing and in communication with the second power coupling;

f) a spacing insulator contacting the first power pole and the second power pole at a generally mid positioned thereon to retain the first power pole and the second power pole at a desired spacing within the interior of the housing;

g) a filament extending from an upper extent of the first power pole to an upper extent of the second power pole, the filament to produce a light during the introduction of the power flow to pass between the first power pole and the second power pole;

h) a focusing lens protective element comprising:

1) a focusing portion having optical qualities to provide for a focusing of the light produced by the filament, the focusing portion radially disposed about the central axis of the housing distal from the housing;

2) an upper tapered portion radially disposed about the central axis of the housing, the upper tapered portion extending from the focusing portion toward the housing, the upper tapered portion having an angle of taper extending outward from the focusing portion toward the housing;

3) a lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion and wherein the angle of taper of the lower tapered portion is between twenty five degrees and twenty seven degrees from the central axis of the housing;

4) a mounting portion extending from the lower tapered portion into the interior of the housing.

9. A self aligning pen light bulb to provide for a production of a beam of light in response to an introduction of a power flow, the self aligning pen light bulb comprising:

a) a housing having:

1) a circular body having an upper extent having an opening thereat, the upper extent having a lip radially disposed about the opening to extend outward from the opening;

2) a circular base positioned distal from the opening at the upper extent of the circular body, the circular base generally planar with an aperture therethrough;

3) an interior formed by the circular body and closed by the circular base;

4) an exterior formed by the circular body and the circular base with at least a portion of the exterior forming a first power coupling to provide for a passage of the power flow from the exterior of the housing to the interior of the housing;

5) a central axis through the interior of the housing and extending from a central position on the circular base to a central position of the opening at the upper extent;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a first power pole positioned within the interior of the housing and in communication with the first power coupling;

e) a second power pole positioned within the interior of the housing and in communication with the second power coupling;

f) a spacing insulator contacting the first power pole and the second power pole at a generally mid positioned thereon to retain the first power pole and the second power pole at a desired spacing within the interior of the housing;

g) a filament extending from an upper extent of the first power pole to an upper extent of the second power pole, the filament to produce a light during the introduction of the power flow to pass between the first power pole and the second power pole;

h) a focusing lens protective element comprising:

1) a focusing portion having optical qualities to provide for a focusing of the light produced by the filament, the focusing portion radially disposed about the central axis of the housing distal from the housing;

2) an upper tapered portion radially disposed about the central axis of the housing, the upper tapered portion extending from the focusing portion toward the housing, the upper tapered portion having an angle of taper extending outward from the focusing portion toward the housing;

3) a lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion and wherein the upper tapered portion further has a measurement of length along the central axis of the housing and wherein the lower tapered portion further has a measurement of length along the central axis of the housing and wherein the measurement of length of the upper tapered portion is generally equal to the measurement of length of the lower tapered portion;

4) a mounting portion extending from the lower tapered portion into the interior of the housing.

10. A self aligning pen light bulb to provide for a production of a beam of light in response to an introduction of a power flow, the self aligning pen light bulb comprising:

a) a housing having:

1) a circular body having an upper extent having an opening thereat, the upper extent having a lip radially disposed about the opening to extend outward from the opening;

2) a circular base positioned distal from the opening at the upper extent of the circular body, the circular base generally planar with an aperture therethrough;

3) an interior formed by the circular body and closed by the circular base;

4) an exterior formed by the circular body and the circular base with at least a portion of the exterior forming a first power coupling to provide for a passage of the power flow from the exterior of the housing to the interior of the housing;

5) a central axis through the interior of the housing and extending from a central position on the circular base to a central position of the opening at the upper extent;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a first power pole positioned within the interior of the housing and in communication with the first power coupling;

e) a second power pole positioned within the interior of the housing and in communication with the second power coupling;

f) a spacing insulator contacting the first power pole and the second power pole at a generally mid positioned thereon to retain the first power pole and the second power pole at a desired spacing within the interior of the housing;

g) a filament extending from an upper extent of the first power pole to an upper extent of the second power pole, the filament to produce a light during the introduction of the power flow to pass between the first power pole and the second power pole;

h) a focusing lens protective element comprising:

1) a focusing portion having optical qualities to provide for a focusing of the light produced by the filament, the focusing portion radially disposed about the central axis of the housing distal from the housing;

2) an upper tapered portion radially disposed about the central axis of the housing, the upper tapered portion extending from the focusing portion toward the housing, the upper tapered portion having an angle of taper extending outward from the focusing portion toward the housing and wherein the upper tapered portion further has a measurement of length along the central axis of the housing and wherein the measurement of length of the upper tapered portion is between two millimeters and two and one half millimeters;

3) a lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion;

4) a mounting portion extending from the lower tapered portion into the interior of the housing.

11. A self aligning pen light bulb to provide for a production of a beam of light in response to an introduction of a power flow, the self aligning pen light bulb comprising:

a) a housing having:

1) a circular body having an upper extent having an opening thereat, the upper extent having a lip radially disposed about the opening to extend outward from the opening;

2) a circular base positioned distal from the opening at the upper extent of the circular body, the circular base generally planar with an aperture therethrough;

3) an interior formed by the circular body and closed by the circular base;

4) an exterior formed by the circular body and the circular base with at least a portion of the exterior forming a first power coupling to provide for a passage of the power flow from the exterior of the housing to the interior of the housing;

5) a central axis through the interior of the housing and extending from a central position on the circular base to a central position of the opening at the upper extent;

b) a second power coupling positioned to extend from the exterior of the circular base generally aligned with the central axis of the housing, the second power coupling to provide for a passage of the power flow to the interior of the housing;

c) an insulator positioned between the second power coupling and the exterior of the circular base to prevent passage of the power flow from the second power coupling and the exterior of the housing;

d) a first power pole positioned within the interior of the housing and in communication with the first power coupling;

e) a second power pole positioned within the interior of the housing and in communication with the second power coupling;

f) a spacing insulator contacting the first power pole and the second power pole at a generally mid positioned thereon to retain the first power pole and the second power pole at a desired spacing within the interior of the housing;

g) a filament extending from an upper extent of the first power pole to an upper extent of the second power pole, the filament to produce a light during the introduction of the power flow to pass between the first power pole and the second power pole;

h) a focusing lens protective element comprising:

1) a focusing portion having optical qualities to provide for a focusing of the light produced by the filament, the focusing portion radially disposed about the central axis of the housing distal from the housing;

2) an upper tapered portion radially disposed about the central axis of the housing, the upper tapered portion extending from the focusing portion toward the housing, the upper tapered portion having an angle of taper extending outward from the focusing portion toward the housing;

3) a lower tapered portion radially disposed about the central axis of the housing, the lower tapered portion extending from the upper tapered portion toward the housing, the lower tapered portion having an angle of taper extending outward from the upper tapered portion toward the housing and wherein the angle of taper of the lower tapered portion is significantly greater than the angle of taper of the upper tapered portion and wherein the lower tapered portion further has a measurement of length along the central axis of the housing and wherein the measurement of length of the lower tapered portion is between two millimeters and two and one half millimeters;

4) a mounting portion extending from the lower tapered portion into the interior of the housing.

* * * * *